US010039434B2

(12) United States Patent
Park et al.

(10) Patent No.: US 10,039,434 B2
(45) Date of Patent: Aug. 7, 2018

(54) HOUSEHOLD APPLIANCE HAVING DRYING APPARATUS

(71) Applicant: SAMSUNG ELECTRONICS CO., LTD., Suwon-si, Gyeonggi-do (KR)

(72) Inventors: Dong Ho Park, Suwon (KR); Eung Ryeol Seo, Suwon (KR); Hyun Joo Jeon, Hwaseong (KR); Jun Kyu Jung, Seongnam (KR); Joo Yong Lee, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 439 days.

(21) Appl. No.: 14/658,903

(22) Filed: Mar. 16, 2015

(65) Prior Publication Data

US 2015/0257627 A1 Sep. 17, 2015

(30) Foreign Application Priority Data

Mar. 17, 2014 (KR) ..... 10-2014-0031065

(51) Int. Cl.
*F26B 3/00* (2006.01)
*A47L 15/48* (2006.01)

(52) U.S. Cl.
CPC ..... *A47L 15/483* (2013.01)

(58) Field of Classification Search
CPC ..... A47L 15/483
USPC ..... 34/468, 483
See application file for complete search history.

(56) References Cited

U.S. PATENT DOCUMENTS

2005/0066538 A1 3/2005 Goldberg et al.
2008/0006308 A1* 1/2008 Classen ..... A47L 15/0013 134/95.2
2008/0235977 A1 10/2008 Kuwabara
2010/0263225 A1 10/2010 Balerdi Azpilicueta et al.
2010/0293804 A1 11/2010 Nawrot et al.
(Continued)

FOREIGN PATENT DOCUMENTS

CN 1600940 A 3/2005
CN 1766213 A 5/2006
(Continued)

OTHER PUBLICATIONS

Chinese Office Action dated Feb. 28, 2017, in corresponding Chinese Patent Application No. 201510115578.6.
(Continued)

*Primary Examiner* — John McCormack
(74) *Attorney, Agent, or Firm* — Staas & Halsey LLP

(57) ABSTRACT

Disclosed is a home appliance provided with a drying apparatus, capable of improving the drying performance. The home appliance includes a body, a dishwashing tub provided in the body and in which a washing operation and a drying operation are conducted, and a drying apparatus provided in the dishwashing tub, and configured to suction air inside the dishwashing tub and discharge the suctioned air to the inside of the dishwashing tub again. The drying apparatus includes a drying duct communicating with the dishwashing tub, a heat pump unit including an evaporator, a compressor, a condenser and an expansion valve, and the evaporator and the condenser are disposed inside the drying duct such that air in the dishwashing tub passes through the evaporator first and then the condenser.

14 Claims, 4 Drawing Sheets

(56) References Cited

U.S. PATENT DOCUMENTS

| | | | | |
|---|---|---|---|---|
| 2011/0000099 | A1* | 1/2011 | Steffens | D06F 58/206 34/493 |
| 2012/0167920 | A1* | 7/2012 | Bertram | A47L 15/0047 134/18 |
| 2014/0007767 | A1* | 1/2014 | Grunewald | A47L 15/481 95/126 |
| 2014/0090413 | A1* | 4/2014 | Hiwata | F04C 23/001 62/468 |

FOREIGN PATENT DOCUMENTS

| | | | | |
|---|---|---|---|---|
| CN | 101113565 | A | 1/2008 | |
| CN | 101275357 | A | 10/2008 | |
| DE | 10 2011 000 042 | | 7/2012 | |
| EP | 2 025 802 | A2 | 2/2009 | |
| EP | 2 064 982 | | 6/2009 | |
| EP | 2 241 242 | A2 | 10/2010 | |
| EP | 2 446 796 | | 5/2012 | |
| EP | 2578741 | A1 * | 4/2013 | A47L 15/0013 |
| EP | 2 682 038 | A2 | 1/2014 | |
| GB | 1 486 725 | | 9/1977 | |
| JP | 2007-117553 | | 5/2007 | |
| JP | 2008-125962 | | 6/2008 | |
| WO | WO 2008/107266 | | 9/2008 | |
| WO | 2009/016173 | A1 | 2/2009 | |
| WO | 2011/080045 | A1 | 7/2011 | |

OTHER PUBLICATIONS

Extended European Search Report dated Jul. 23, 2015 in corresponding European Patent Application No. 15159228.4.

European Decision on Grant dated Jan. 9, 2017, in corresponding European Patent Application No. 15 159 228.4.

Chinese Office Action dated Aug. 16, 2017 in Chinese Patent Application No. 201510115578.6.

Chinese Notice of Allowance dated Nov. 24, 2017 in Chinese Patent Application No. 201510115578.6.

* cited by examiner

HOUSEHOLD APPLIANCE HAVING DRYING APPARATUS

CROSS-REFERENCE TO RELATED APPLICATION

This application claims the priority benefit of Korean Patent Application No. 10-2014-0031065, filed on Mar. 17, 2014, in the Korean Intellectual Property Office, the disclosure of which is incorporated herein by reference.

BACKGROUND

1. Field

Embodiments of the present disclosure relate to a home appliance, and more particularly, a home appliance having a drying apparatus capable of improving a drying performance.

2. Description of the Related Art

In the recent years, there are increasing demands for a home appliance having a drying function, for example, a dish washer, a washing machine, and a drier. A dish washer is provided with a drying function to remove wash water that remains on washed dishware, and a washing machine and a drier are provided with a drying function to dry wet laundry.

The dish washer is an apparatus designed to wash dishes in an effective and hygienic way, and wash and dry dishes having dirt. A dry process of the dish washer represents a process of removing moisture remaining on the dishes having finished with washing. The dry process includes increasing the temperature of dishware by increasing the temperature of water sprayed to the dishware in a final rinse process such that evaporation of water remaining on the dishware is enhanced, and removing the evaporated vapor by condensation in a cooling duct positioned inside or outside a dishwashing tub or by absorption through a dehumidifying agent.

When the dehumidifying agent is used in order to remove a vapor, a reproduction process is required to dry the dehumidifying agent so that the dehumidifying agent may absorb a vapor in the next drying process. In the conventional technology, the dehumidifying agent is heated using a heater during a washing process or a rinsing process. The dehumidifying agent is heated using a heater to evaporate moisture of the dehumidifying agent to regenerate the dehumidifying agent so that the regenerated dehumidifying agent may absorb moisture again in the subsequent drying process.

In general, the dishwasher uses a porous dehumidifying agent, and a vapor absorbed into the dehumidifying agent is accommodated in a gas state or liquid state in the pores of the porous dehumidifying agent.

In order to regenerate the porous dehumidifying agent, energy (latent heat of vaporization) is needed to change water accommodated in the pores in a liquid state into a vapor state, and further, an additional energy is needed to allow the vapor to escape from the pores. Accordingly, there is a need for a great amount of thermal energy in regenerating the dehumidifying agent, which increases the energy consumption.

SUMMARY

Therefore, it is an aspect of the present disclosure to provide a home appliance having a drying apparatus.

It is another aspect of the present disclosure to provide a home appliance having a drying apparatus, capable of enhancing the drying efficiency while saving the energy required in a drying cycle.

In accordance with an aspect of the present disclosure, a home appliance includes a body, a dishwashing tub and a drying apparatus. The dishwashing tub may be provided in the body and in which a washing operation and a drying operation are conducted. The drying apparatus may be provided in the dishwashing tub, and configured to suction air inside the dishwashing tub and discharge the suctioned air to the inside of the dishwashing tub again. The drying apparatus may include a drying duct and a heat pump unit and a heat pump unit. The drying duct may communicate with the dishwashing tub. The heat pump unit may include an evaporator, a compressor, a condenser and an expansion valve. The evaporator and the condenser may be disposed inside the drying duct such that air in the dishwashing tub passes through the evaporator first and then the condenser.

Each of the evaporator and the condenser may be formed in a panel shape.

The drying duct may include a suction port formed to communicate with the inside of the dishwashing tub so as to suction air of inside the dishwashing tub.

The drying apparatus may include a drain member to drain condensation water generated from the heat pump unit.

The drain member may be disposed at a lower side of the evaporator and downwardly inclined toward a drain hole formed at the drying duct such that the condensation water is discharged through the drain hole.

The evaporator may be disposed at an upper portion of the drying duct, and the condenser may be disposed at a lower portion of the drying duct.

The compressor may be disposed on a bottom surface of the body.

The compressor may have a power consumption of about 80 W to 300 W.

The compressor may have a capacity of about 2 C to 15 CC.

The heat pump unit may use a refrigerant including at least one of R-134a, R-600a, R-407C and R410A.

The drying apparatus may further include a circulation fan mounted inside the drying duct.

In accordance with another aspect of the present disclosure, a drying apparatus includes a drying duct and a heat pump unit. The drying duct may be provided with a suction port communicating with a dishwashing tub in which a washing operation and a drying operation are conducted. The heat pump unit may include an evaporator, a compressor, a condenser, an expansion valve and a circulation fan. The evaporator and the condenser may be sequentially disposed inside the drying duct such that air in the dishwashing tub passes through the condenser after passing through the evaporator.

The evaporator may be disposed upward of the condenser at the drying duct.

The drying apparatus may further include a drain member to drain condensation water generated from the heat pump unit. The drain member may be disposed at a lower side of the evaporator, and downwardly inclined toward a drain hole formed at the drying duct such that the condensation water is discharged through the drain hole

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Reference will now be made in detail to the embodiments of the present disclosure, examples of which are illustrated in the accompanying drawings. The present disclosure may be applied to all types of home appliance configured to dry a drying space. The drying space represents a space in which water is used and thus a drying process is needed to dry the water.

For example, a dishwashing tub provided in a dishwasher and in which a washing of dishware is conducted, a washing tub provided in a washing machine and in which a washing of laundry is conducted, and a drying compartment provided in a drier.

Figure 1:
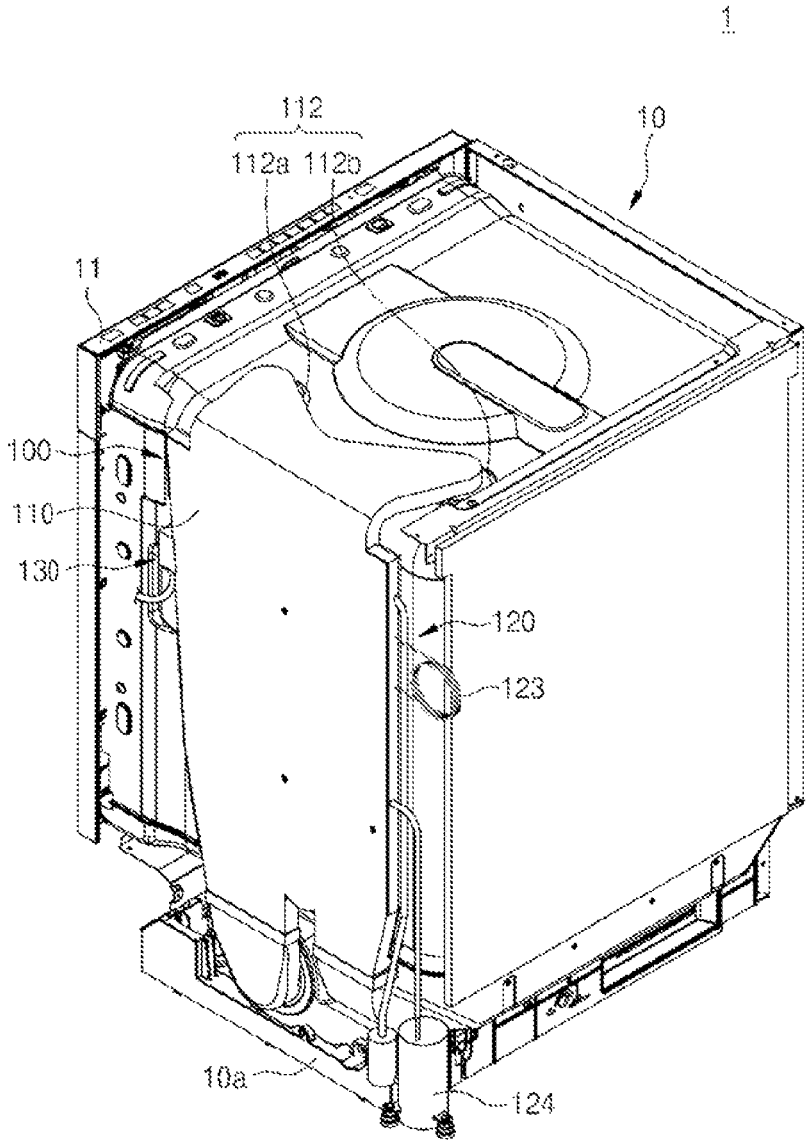
FIG. 1 is a view illustrating a dishwasher in accordance with an embodiment of the present disclosure.
Figure 2:
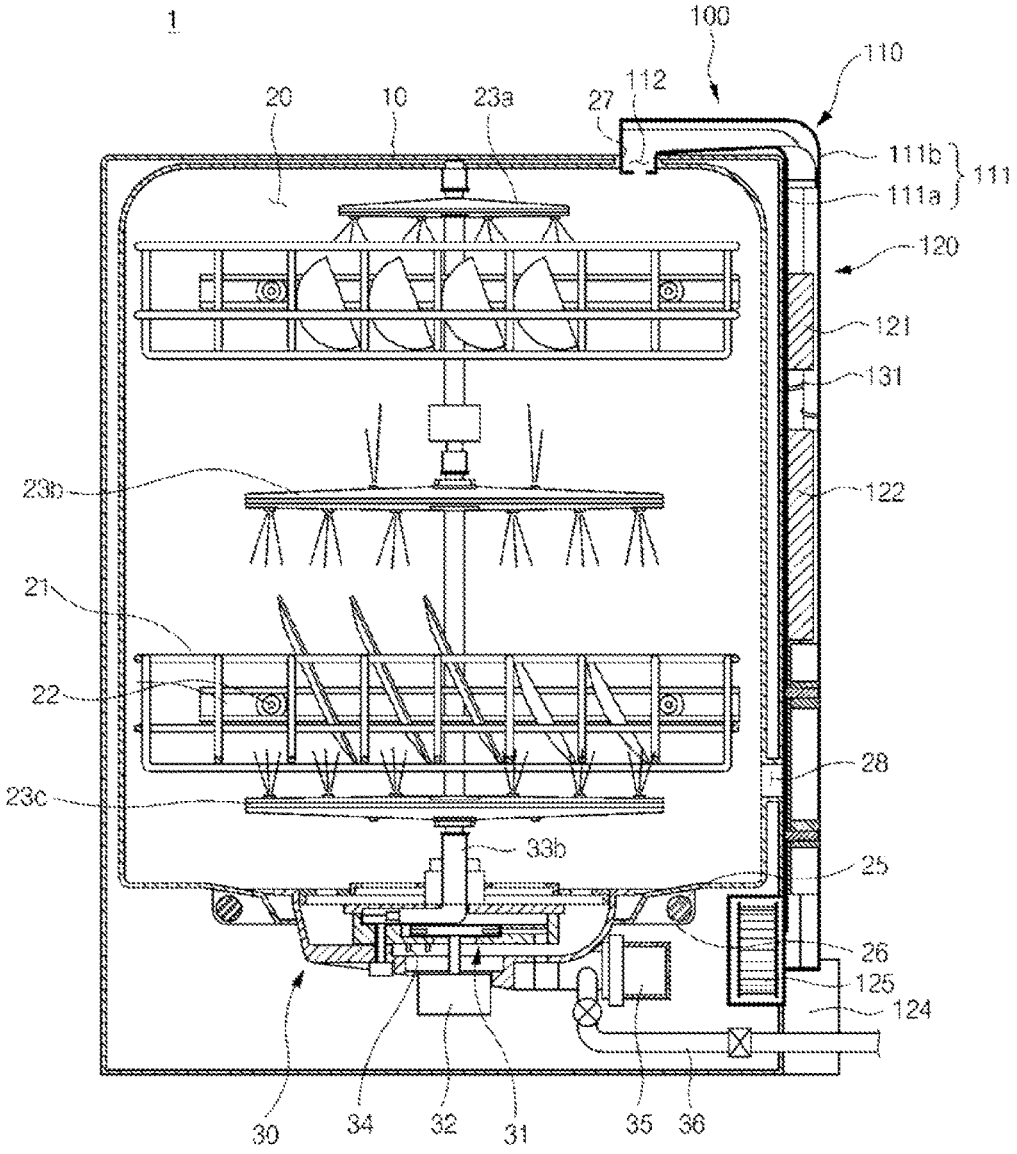
FIG. 2 is a cross-sectional view illustrating main parts of a dishwasher in accordance with an embodiment of the present disclosure.

FIG. 1 is a view illustrating a dishwasher in accordance with an embodiment of the present disclosure, and FIG. 2 is a cross-sectional view illustrating main parts of a dishwasher in accordance with an embodiment of the present disclosure.

Referring to FIGS. 1 and 2, a dishwasher 1 includes a body 10, a dishwashing tub 20 provided inside the body 10 to form a dishwashing space, a sump 30 provided at a lower side of the dishwashing tub 20 to store wash water, and a door 11 having a lower end thereof rotatably installed at a lower portion of the body 10 to open and close the body 10.

The dishwashing tub 20 is provided at an inside thereof with at least one dishware basket 21 to accommodate dishware therein, at least one rack 22 slidably supporting the at least one dishware basket 21, and at least one spraying nozzle 23 to splay wash water. The at least one spraying nozzle 22 may be composed of a top nozzle 23*a*, an upper nozzle 23*b* and a lower nozzle 23*c*.

A water supply unit (not shown) is provided at the dishwashing tub 20 to supply wash water. The water supply unit may be provided at a sidewall of the dishwashing tub 20. The wash water may be supplied to the inside of the dishwashing tub 20 through the water supply unit 24.

A heater 25 configured to heat wash water and a heater installation groove 26 may be provided at an inside of the body 10. The heater installation groove 26 may be provided on the bottom of the dishwashing tub 20, and the heater 25 may be installed in the heater installation groove 26.

The sump 30 is provided in the center of the bottom of the dishwashing tub 20 to collect and pump wash water.

The sump 30 may include a dishwashing pump 31 to pump wash water at a high pressure and a pump motor 32 to operate the dishwashing pump 31. The dishwashing pump 31 pumps out wash water to the top nozzle 23*a* and the upper nozzle 23*b* through a first supply pipe 33*a*, and through a second supply pipe 33*b*, pumps out wash water to the lower nozzle 23*c*.

The sump 30 may include a turbidity sensor 34 to detect the degree of contamination of wash water. A controller (not shown) of the dishwasher 1 may detect the degree of contamination of wash water by using the turbidity sensor 34, so that the number of washing operations or rinsing operations may be controlled. That is, when the degree of contamination is high, the number of the washing operations or rinsing operations may be increased, and when the degree of contamination is low, the number of the washing operations or rinsing operations may be decreased.

In addition, a drain pump 35 and a drain pipe 36 may be installed at one side of the sump 30 to discharge contaminated water to the outside of the dishwasher.

When the washing of the dishware is completed, a drying process is performed to remove wash water remaining on the dishware and the dishwashing tub 20.

Accordingly, the dishwasher 1 is provided with a drying apparatus 100 to dry the inside of the dishwashing tub 20.

Figure 3:
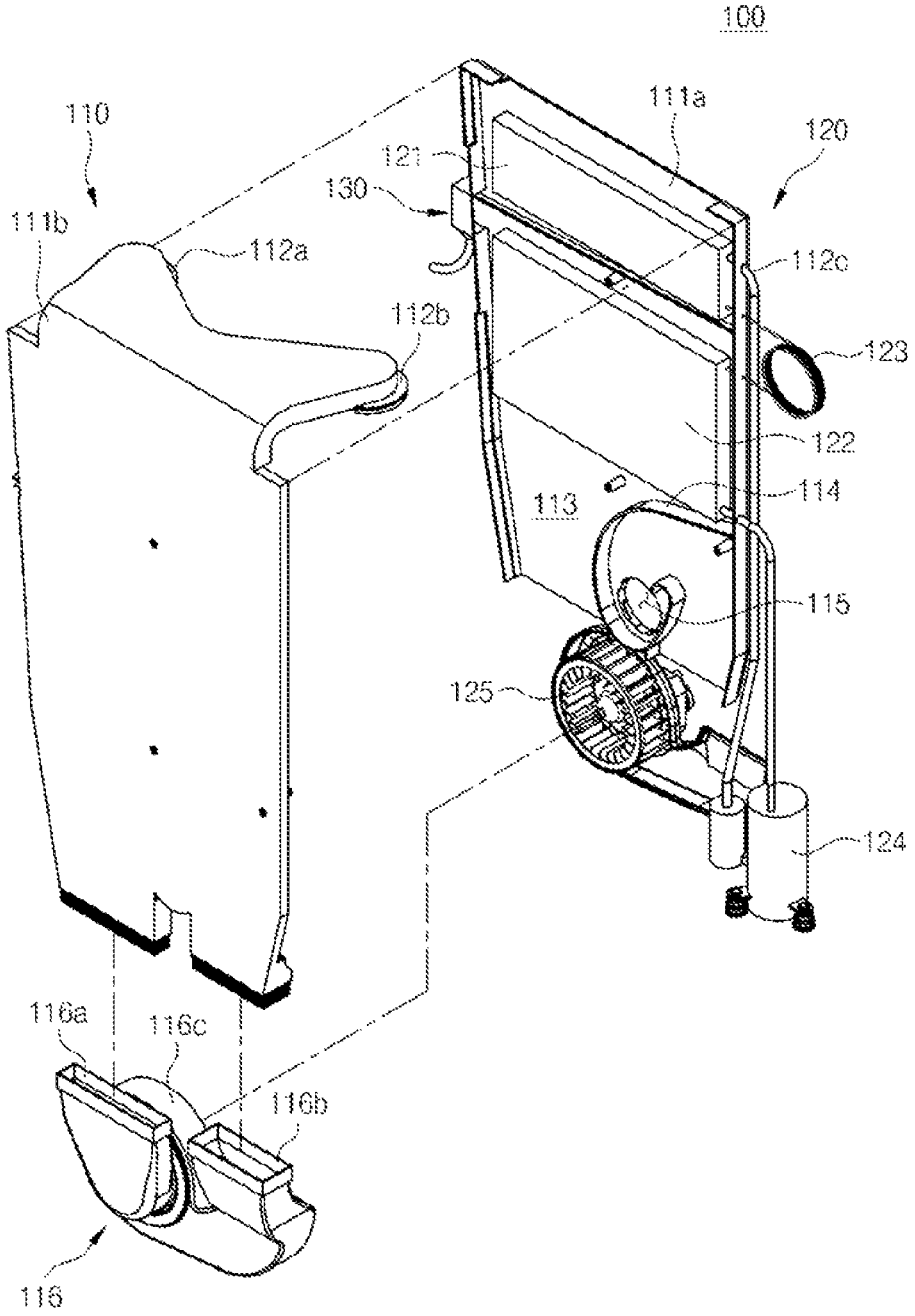
FIG. 3 is a view illustrating a drying apparatus of a dishwasher in accordance with an embodiment of the present disclosure.
Figure 4:
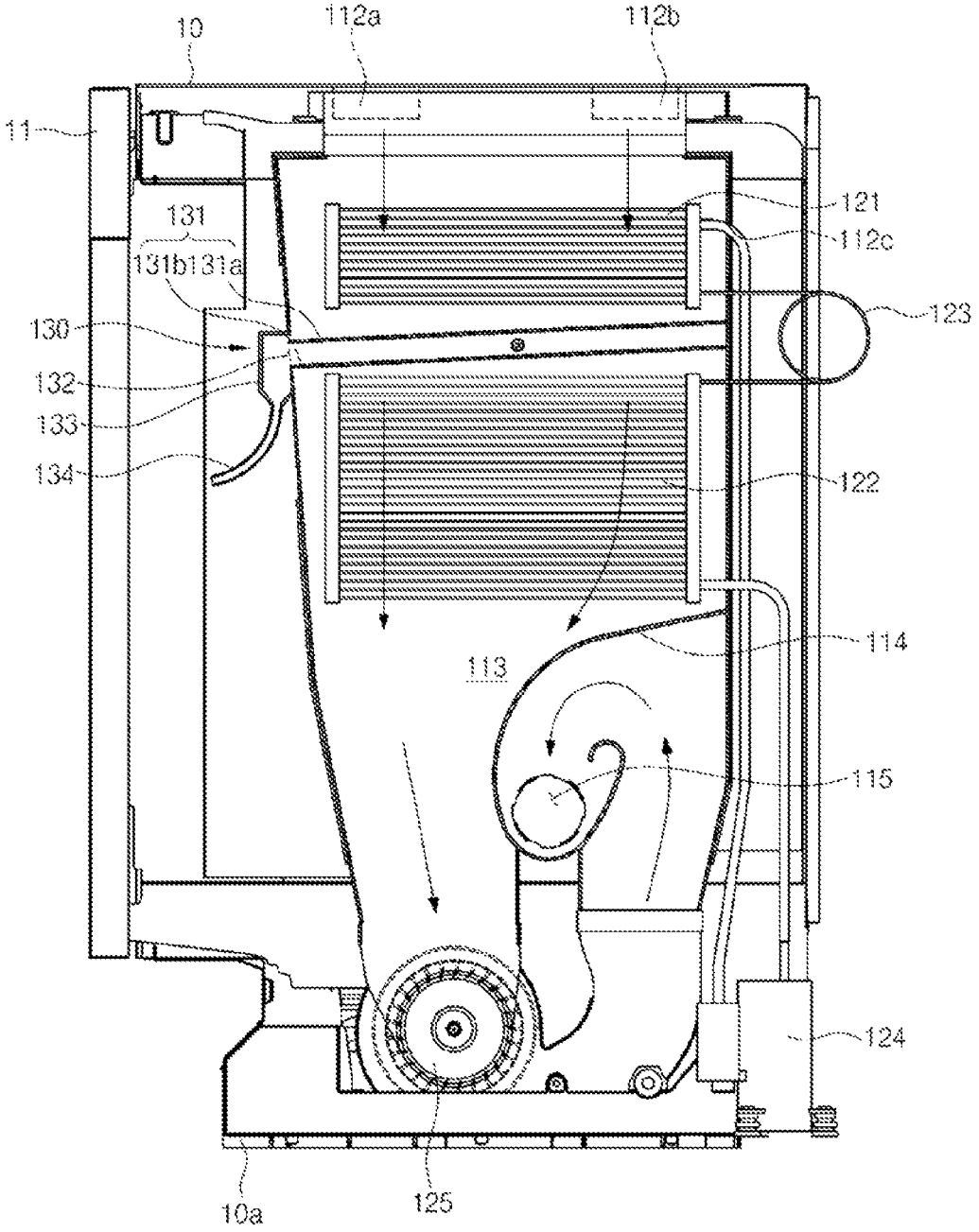
FIG. 4 is a view illustrating the interior of the drying apparatus in accordance with an embodiment of the present disclosure.

FIG. 3 is a view illustrating a drying apparatus of a dishwasher in accordance with an embodiment of the present disclosure, and FIG. 4 is a view illustrating the interior of the drying apparatus in accordance with an embodiment of the present disclosure.

Referring to FIGS. 3 and 4, the drying apparatus 100 includes a drying duct 110 disposed outside the dishwashing tub 20 and communicating with the dishwashing tub 20, and a heat pump unit 120 at least one portion of which is disposed inside the drying duct 110.

The drying duct 110 includes a case 111 forming the external appearance thereof. The case 11 includes a first case 111*a* installed while coming into contact with the dishwashing tub 20, a second case 111*b* coupled to the first case 111*a* from outside of the first case 111*a*, and a third case 116 provided at a lower side of the first case 111*a* and the second case 111*b*.

A drying path 113 is provided between the first case 111*a* and the second case 111*b* such that air transferred from the dishwashing tub 20 while containing a vapor and suctioned to the inside of the drying duct 110 flows along the drying path 113.

The first case 111*a* may be provided with a guide partition wall 114 to guide air flow inside the drying path 113 and a discharge port 115 to discharge air dried in the drying path 133 to the inside of the dishwashing tub 20.

Meanwhile, a suction port 112 is provided at an upper end of the second case 111*b* to suction air inside the dishwashing tub 20.

The third case 116 may be provided with a circulation fan installation portion 116*c* on which a circulation fan 125 is provided. The circulation fan 125 is provided to allow air suctioned through the suction port 112 to the inside of the drying path 133 to be discharged to the inside of the dishwashing tub 20.

The third case 116 may be provided with an inlet port 116*a* and an outlet port 116*b* to introduce and discharge air by operation of the circulation fan 125.

Although the third case 116 according to the embodiment of the present disclosure is illustrated as being separately provided from the first case 111*a* and the second case 111*b*, the aspect of the present disclosure is not limited thereto. For example, the third case may be integrally formed with the first case or the second case.

In this manner, air inside the dishwashing tub 20 is suctioned to the drying duct 110, and a vapor of the air is removed by a part of the heat pump unit 120 disposed inside the drying duct 110, and then discharged to the inside of the dishwashing tub 20 again.

In order to suction air in the dishwashing tub 20 to the inside of the drying duct 110 and then discharge the air to the inside of dishwashing tub 20 again, the drying duct 110 is provided with the suction port 112 and the discharge port 115.

The suction port 112 and the discharge port 115 are provided to communicate with the inside of the dishwashing tub 20. In the drying process, air containing a vapor of inside the dishwashing tub 120 is suctioned to the drying duct 110 through the suction port 112. The dishwashing tub 20 is provided with an outtake port 27 at a position corresponding to the suction port 112. The outtake port 27 may be formed at an upper portion of the dishwashing tub 20. Although the suction port 112 according to the embodiment of the present disclosure is illustrated as being composed of a first suction port 112 and a second suction port 112, the present disclosure is not limited thereto. For example, in order to effectively suction air of inside the dishwashing tub 20, the suction port 112 may be provided in a plurality thereof depending on a demand Meanwhile, the discharge port 115 is formed to communicate with the inside of the dishwashing tub 20 to discharge air having a vapor removed therefrom toward the dishwashing tub 20 again. To this end, the dishwashing tub 20 may be provided with an intake port 28 at a position corresponding with the discharge port 115. Preferably, the intake portion 28 may be provided at a left side portion and a right side portion of the dishwashing tub 20.

Air of inside the dishwashing tub 20 may circulate by sequentially passing through the suction port 112, the drying path 113 and the discharge port 115.

Air of inside the dishwashing tub 20 contains a vapor, and may be condensed in the course of passing through the drying path 113.

The heat pump unit 120, which includes an evaporator 121, a compressor 124, a condenser 122 and an expansion value 123, has the evaporator 121 and the condenser 122 disposed in the drying path 113 of the drying duct 110.

In this case, each of the evaporator 121 and the condenser 122 is provided in a panel shape, and for this, each of the evaporator 121 and the condenser 122 include has pipes (not shown) each having an inner diameter of 4 mm to 12 mm.

In addition, the evaporator 121 has fins (not shown) disposed while spaced apart from each other by an interval of about 1.0 mm to 3 mm, and the fins are subject to hydrophilicity treatment such that the condensation water is effectively drained.

Meanwhile, each of the first case 111*a* and the second case 111*b*, composing the drying duct 110, is provided with a plurality of installation holes 112*c* passing through sides thereof so that the evaporator 121 and the condenser 122 are installed inside the first case 111*a* and the second case 111*b*.

Preferably, the condenser 122 has fins (not shown) disposed while spaced apart from each other by an interval of about 1.0 mm to 2 mm.

In addition, the expansion valve 123 has an inner diameter of about 0.6 mm to 1.5 mm.

The compressor 124 has a power consumption of about 80 W to 300 W, and has a capacity of about 2 CC to 15 CC.

In this case, the compressor 124 may be installed on a lower surface 10*a* of the body 10. A machine compartment (not shown) is provided at a lower side of the dishwashing tub 20 in the body 10 such that the sump 30 is installed in the machine compartment.

A refrigerant applied to the heat pump unit 120 includes at least one of R-134a, R-600a, R-407C and R410A.

Meanwhile, the evaporator 121 is disposed upward of the condenser 122 at the drying duct 110 such that air containing a vapor of the dishwashing tub 20 and suctioned through the suction port 112 passes through the evaporator 121 earlier than the condenser 122.

Moistened air containing a vapor of the dishwashing tub 20, while passing through the evaporator 121, has water therein condensed, and the air dehydrated through the evaporator 121, while passing through the condenser 122, is heated so that the heated dry air is introduced to the inside of the dishwashing tub 200 through the discharge port 115.

The drying duct 110 is provided at an inside thereof with a drain member 130 to drain condensation water formed by condensation through the evaporator 121.

The drain member 130 may include a drain rib 131 to guide condensation water collected downwardly along a surface of the evaporator 121 to move, a condensation water accommodation unit 133 to accommodate condensation water collected at an end of the drain rib 131 and a drain pipe 134 connected such that condensation water of the condensation water accommodation unit 133 is discharged to the outside.

The drain rib 131 includes a first drain rib 131*a* that are downwardly inclined to move condensation water and provided on the first case 111*a* and the second drain rib 131*b* provided on the second case 111*b*, respectively.

The first drain rib 131*a* and the second drain rib 131*b* are disposed at a lower side of the evaporator 121 such that condensation water flowing along a surface of the evaporator 121 moves to the condensation water accommodation unit 133 through the drain rib 131 without leaking.

In addition, a drain hole 132 is formed in the drying duct 110 at a position corresponding to a lower side end of the drain rib 131 such that condensation water moving through the drain rib 131 moves to the condensation water accommodation unit 133.

Although the drain pipe 134 according to the embodiment of the present disclosure is illustrated as being connected to the condensation water accommodation unit 133 to drain condensation water of the condensation water accommodation unit 133 to the outside of the body 10, the present disclosure is not limited thereto. For example, the drain pipe 134 may be connected to the inside of the washing tub 20 such that condensation water is drained to the inside of the dishwashing tub 20.

Due to the evaporator 121 and the condenser 122 of the heat pump unit 120, which are provided in the drying duct 110, air of inside the dishwashing tub 20 containing vapor and introduced through the suction port 112 of the drying duct 110 is condensed by passing through the evaporator 121 and dried by passing through the condenser 122. The dried air is discharged to the inside of the dishwashing tub 20 through the discharge port 115.

Accordingly, there is no need for thermal energy required to regenerate a dehumidifying agent for drying, and an additional part for the thermal energy, for example, a heater, so that energy consumption is reduced, and a spatial efficiency is improved.

As is apparent from the above, the drying performance can be improved while saving the energy required in the drying cycle by using a heat pump drying system.

In addition, furniture can be prevented from being damaged due to moistened vapor that may be discharged during a drying cycle of the dishwasher, and the product quality can be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A home appliance comprising:

a body;

a dishwashing tub provided in the body and in which a washing operation and a drying operation are conducted; and a drying apparatus including:

a drying duct communicating with the dishwashing tub; and a heat pump unit including:

a condenser disposed inside the drying duct and at a higher level in the body than a lower surface of the dishwashing tub, an evaporator disposed inside the drying duct above the condenser and substantially vertically aligned with the condenser, at least one drain rib disposed inside the drying duct below the evaporator and above the condenser, and downwardly inclined toward a drain hole to guide water condensed on the evaporator out of the drying duct through the drain hole, a compressor, and an expansion valve, the drying apparatus configured to:

suction air inside the dishwashing tub from an upper portion of the dishwashing tub, pass the suctioned air through the evaporator and then through the condenser, and discharge the suctioned air, after passing through the condenser, to the inside of the dishwashing tub at a portion of the dishwashing tub that is lower than the upper portion of the dishwashing tub, to thereby circulate the air inside the dishwashing tub.

2. The home appliance of claim 1, wherein each of the evaporator and the condenser is formed in a panel shape.

3. The home appliance of claim 1, wherein the drying duct includes a suction port formed to communicate with the inside of the dishwashing tub so as to suction air inside of the dishwashing tub.

4. The home appliance of claim 1, wherein the at least one drain rib includes:

a first drain rib disposed on a first side of the drying duct, and a second drain rib disposed on a second side of the drying duct opposite the first side of the drying duct.

5. The home appliance of claim 4, wherein the first drain rib is disposed substantially parallel with the second drain rib.

6. The home appliance of claim 2, wherein:

the evaporator is disposed at an upper portion of the drying duct; and the condenser is disposed at a lower portion of the drying duct.

7. The home appliance of claim 2, wherein the compressor is disposed on a bottom surface of the body.

8. The home appliance of claim 2, wherein the compressor has a power consumption of about 80 W to 300 W.

9. The home appliance of claim 2, wherein the compressor has a capacity of about 2 C to 15 CC.

10. The home appliance of claim 1, wherein the heat pump unit uses a refrigerant including at least one of R-134a, R-600a, R-407C and R410A.

11. The home appliance of claim 1, wherein the drying apparatus further includes a circulation fan mounted inside the drying duct.

12. A drying apparatus comprising:

a drying duct provided with a suction port communicating with a dishwashing tub at an upper portion of the dishwashing tub, in which a washing operation and a drying operation are conducted; and a heat pump unit including:

an evaporator disposed inside the drying duct, a condenser disposed inside the drying duct below the evaporator and at a higher level than a lower surface of the dishwashing tub, at least one drain rib disposed inside the drying duct below the evaporator and above the condenser, and downwardly inclined toward a drain hole to guide water condensed on the evaporator out of the drying duct through the drain hole, a compressor, an expansion valve, and a circulation fan, wherein:

the evaporator and the condenser are sequentially disposed inside the drying duct, such that air in the dishwashing tub is to be circulated inside the dishwashing tub by being:

suctioned from the upper portion of the dishwashing tub via the suction port, after being suctioned from the upper portion, passed through the evaporator and then through the condenser, and after being passed through the condenser, discharged at a portion of the dishwashing tub that is lower than the upper portion of the dishwashing tub, such that the air is circulated inside the dishwashing tub.

13. The drying apparatus of claim 12, wherein the evaporator is substantially vertically aligned with the condenser in the drying duct.

14. The drying apparatus of claim 12, wherein the at least one drain rib includes:

a first drain rib disposed on a first side of the drying duct, and a second drain rib disposed on a second side of the drying duct opposite the first side of the drying duct.

* * * * *